US005125316A

United States Patent [19]

Markle

[11] Patent Number: 5,125,316

[45] Date of Patent: Jun. 30, 1992

[54] CARTRIDGE CASE FLASH HOLE UNIFORMER

[76] Inventor: Kenneth E. Markle, 2525 Primrose La., York, Pa. 17404

[21] Appl. No.: 753,369

[22] Filed: Aug. 30, 1991

[51] Int. Cl.[5] ..... F42B 33/00; F42B 35/02

[52] U.S. Cl. ..... 86/24; 86/37; 29/1.3

[58] Field of Search ..... 86/24, 1.1, 28, 17, 86/19, 36-38; 408/127, 154-156, 173, 202, 203; 29/1.3, 1.31, 1.32

[56] References Cited

U.S. PATENT DOCUMENTS 4,273,024 6/1981 Veloni ..... 86/24 X 4,807,511 2/1989 Markle ..... 86/24

5,050,475 9/1991 Kolmer ..... 86/23

*Primary Examiner*—Brian S. Steinberger

*Attorney, Agent, or Firm*—Samuel M. Learned, Jr.

[57] ABSTRACT

An improved cartridge case flash hole uniformer having a hardened self-cleaning reaming and chamfering blade for use either as a hand tool or with a power drive for providing the consistent case to case uniforming of flash holes to facilitate the communication of a uniform bloom of detonating primer flash from the primer pocket by way of the flash hole into the cartridge case power chamber in turn for consistently generating uniform propellant charge ignition, and thereby enhance the cartridge factor accuracy of reloaded ammunition from round to round for match and precision bench rest shooting applications.

7 Claims, 3 Drawing Sheets

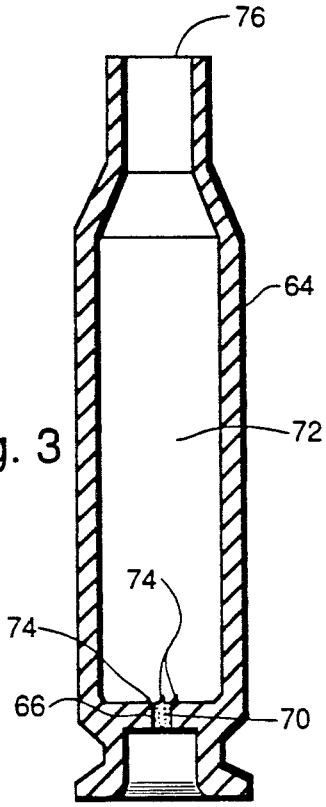
Fig. 3
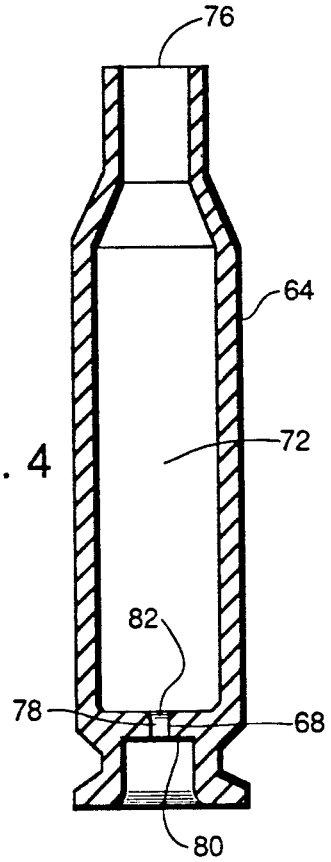
Fig. 4
Fig. 9
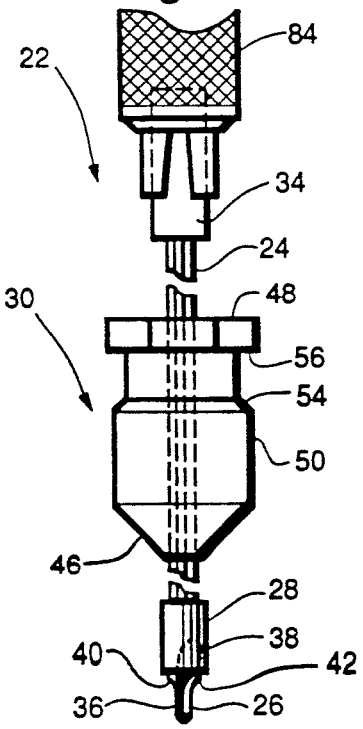
Fig. 10
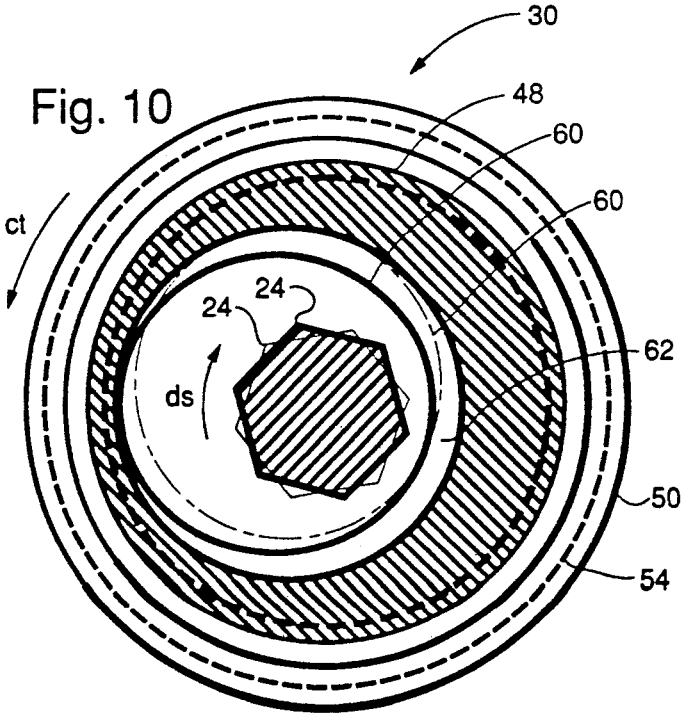

a
b
c
f
r
x
w

CARTRIDGE CASE FLASH HOLE UNIFORMER

BACKGROUND OF THE INVENTION

Among the marksmanship arts is that known as "match" or "bench rest" shooting, participated in by highly skilled and practiced individuals employing finely tuned firearms and so-called "match" ammunition. The object of such marksmanship is basically the placement of all bullets through the same hole on the target at whatever range is being fired. In the accomplishment of such a marksmanship feat, the mechanical variables in ammunition performance must be reduced to a minimum, and in the subject of this disclosure it is specifically the cartridge case flash hole considerations attributable to reducing ballistic variables in ammunition performance to a minimum with which we are dealing.

The present invention relates to an improved cartridge case flash hole uniforming tool of a type employed by those engaged in reloading the cases of spent cartridges primarily for use in high accuracy applications such as those previously described as match or bench rest shooting, and in particular to a tool specifically adapted to consistently provide a reamed flash hole profile and chamfered opening therefrom into the cartridge case powder chamber that will, from cartridge to cartridge, communicate a uniform full-blown primer flash bloom from the primer pocket to the powder chamber for consistent ignition and detonation of the propellant charge so that cartridge factor accuracy attributable to propellant burning profiles and pressure generation in providing bullet driving force is highly consistent and uniformily repeatable from round to round.

Flash hole reaming and chamfering operations have been previously accomplished by reloaders primarily as a manual operation employing a uniforming tool such as that one shown and taught in U.S. Pat. No. 4,807,511 dated Feb. 28, 1989, by Markle, the applicant herein, which tool represented a substantial improvement over the state of the art then existent, and to this date remains fully adequate for flash hole uniforming in general reloading operations to provide cartridges intended to be used in typical target shooting and hunting activities. However, where the nature of shooting accuracy fully demands a reduction to an absolute minimum of all variables, including those attributable to cartridge accuracy factors with respect to reliably repeatable ammunition performance characteristics from round to round, flash hole reaming and chamfering preparation with the improved uniformer of instant invention does provide a distinct improvement over currently available tools for this purpose as more fully set forth in the detailed description of the invention that follows.

SUMMARY OF THE INVENTION

It is the principal object of the present invention to provide an improved cartridge case flash hole uniformer for use in preparing cartridge cases for reloading, which uniformer incorporates as features thereof an auger having a hardened self cleaning cutting blade for the reaming of a spent cartridge case flash hole to a uniform straight-walled diameter consistently from case to case, wherein the blade is profiled to upwardly provide thereon a radiused enlargement to thereby further enable the smooth uniform chamfering of a beveled cartridge case interior opening about the flash hole circumference to facilitate the communication of a uniform bloom of detonating primer flash from the primer pocket by way of the flash hole into the cartridge case powder chamber in turn for consistently uniform propellant charge ignition, and thereby enhance the cartridge factor accuracy of reloaded ammunition from round to round.

It is another object of the present invention to provide an improved cartridge case flash hole uniformer having a hardened flash hole auger depth stop shoulder upwardly of the radiused enlargement thereof, to enable a uniform depth of smooth uniform chamfering of a beveled cartridge case interior opening about the flash hole circumference from case to case.

A further object of the present invention is to provide an improved cartridge case flash hole uniformer which may be used equally well as either a hand tool or a power driven tool when employed with either a slow speed drill press or a cordless powered screwdriver handle.

It is also an object of the present invention to provide an improved cartridge case flash hole uniformer having an adjustably set and lockable spring loaded centering cone for maintaining the auger drive shaft in a direct aligned and centered disposition from the cartridge case mouth to the flash hole opening during flash hole reaming and chamfering operations.

The foregoing and other objects hereof, will be readily evident upon a study of the following specification and accompanying drawings comprising a part thereof.

BRIEF DESCRIPTION OF THE DRAWINGS

FIG. 3 is a vertical section of an exemplary spent cartridge case before uniforming of the flash hole thereof.

FIG. 4 is a vertical section corresponding to the previously shown exemplary spent cartridge case, but after reaming and chamfering of the flash hole thereof with the improved uniformer of instant invention.

FIG. 9 is an illustration of the improved uniformer of instant invention shown installed in a power tool chuck for the mechanically driven employment thereof, wherein said view is foreshortened to accommodate the same to the sheet.

FIG. 10 is an enlarged top sectional view of the adjustably set and lockable spring loaded centering cone, as shown in FIG. 2 and seen along the line 10—10 thereof.

DETAILED DESCRIPTION OF THE INVENTION

Figure 1:
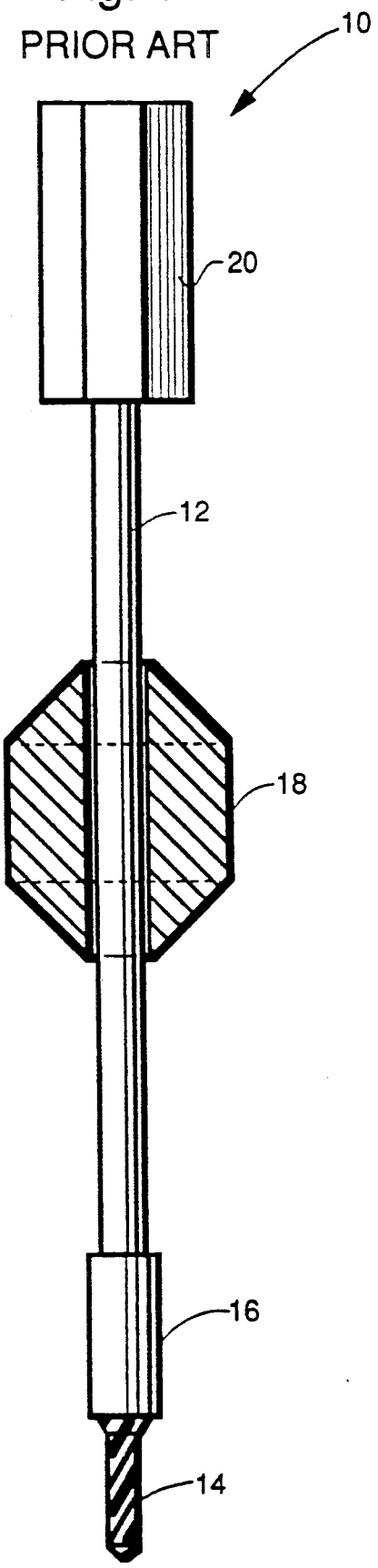
Fig. 1 PRIOR ART
FIG. 1 is a side elevation view of a typical prior art cartridge case flash hole uniforming tool.

Referring to FIG. 1, a prior art cartridge case flash hole uniforming tool 10 is shown, which is typically comprised of an elongated central support and drive shaft 12 having assembled on axial alignment at one end thereof a suitable twist drill 14 for reaming and uniforming a spent cartridge case flash hole to a standard radial dimension, a stop sleeve 16 which primarily functions to limit the drill 14 extension through a flash hole by serving as a shoulder which bottoms out on the cartridge case interior base surface at full drill 14 insertion therethrough as well as providing mechanical support for the drill to drive shaft connection in addition to being a limiting stop for the slidable case mouth centering cone 18 whereby the drive shaft 12 is maintained in an aligned and centered disposition during flash hole reaming operations, and a handle 20 assembled at the other end of the support and drive shaft 12 whereby the tool 10 is held and manually manipulated rotationally to effect flash hole uniforming. The manner of use of the prior art tool 10 is well known to those skilled in the methods and technique of cartridge case preparation for reloading, and is fully detailed in applicant's previous uniforming tool patent cited above.

Figure 2:
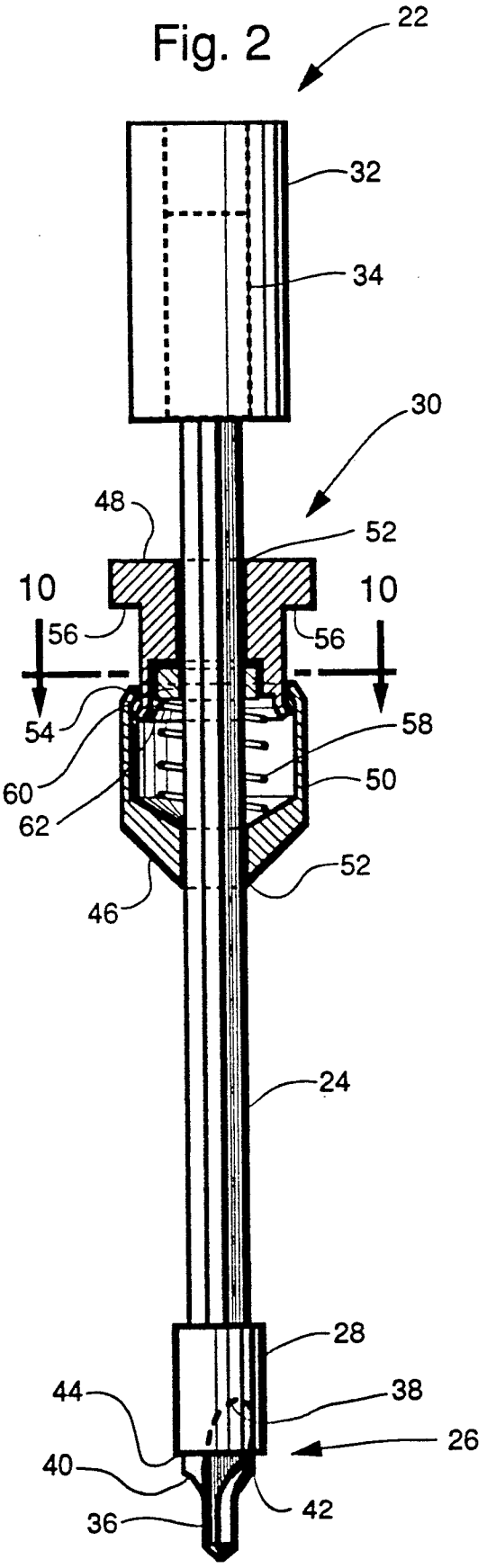
FIG. 2 is a side elevation view of the improved cartridge case flash hole uniformer of present invention, with the adjustably set and lockable spring loaded centering cone thereof being shown in vertical section to better illustrate the detail and workings thereof.

Referring now to FIG. 2, wherein is shown the improved cartridge case flash hole uniformer 22 of instant invention, which has a hexagonally shaped elongated central support and drive shaft 24 to which is affixed a hardened self-cleaning reaming and chamfering blade 26 for reaming and uniforming a spent cartridge case flash hole to a standard radial dimension the same being fixedly assembled on axial alignment to one end of said drive shaft 24, a retaining sleeve 28 which in the improved uniformer 22 functions first to provide a mechanical support for the blade to drive shaft connection and second as a limiting stop for the adjustably set and lockable spring loaded centering cone 30 whereby the drive shaft 24 is maintained in an axially aligned and centered disposition within a cartridge case interior during flash hole reaming and chamfering operations with said uniformer 22, and a pliable detachable handle 32 assembled to the other end of said drive shaft 24 which provides the means for facilitated manually rotated manipulative use of said uniformer 22 or when slidably removed therefrom enabling the chucking lug 34 to be insertably secured within a rotary power drive chuck such as that of a slow speed drill press or cordless powered screwdriver handle for mechanically rotated use of said uniformer 22.

Referring again to FIG. 2 to explain in greater detail the structural and functional aspects of the newly embodied aforementioned assemblies in the improved uniformer 22, and considering first in these regards the hardened self-cleaning reaming and chamfering blade 26. The cutting mandrel shank 36 and the chip plenum 38 of the self-cleaning blade 26 are of conventional profile and mechanical function with respect to augers of this type. The blade 26, however, in the instant use is distinguished by being provided with a hardened radiused enlargement 40 at the top of the cutting mandrel shank 36 which enlargement functions to cut a smooth uniform chamfering of a beveled cartridge case interior opening about the flash hole circumference at completion of reaming when the hardened blade shoulder 42 bottoms out on the cartridge case interior base surface at full blade 26 reaming insertion through the cartridge case flash hole opening, all as will hereinafter be more fully described on subsequent consideration of FIGS. 5 through 8. It is the bottoming out registering of the blade 26 extension against the hardened blade shoulder 42, however, rather than against the softer retaining sleeve shoulder 44, which enables effective and sustained use of the improved uniformer with a powered drive means such as a slow speed drill press or a cordless powered screwdriver handle.

Another novel and advantageous feature of the uniformer 22 of instant invention is that of the adjustably set and lockable spring loaded centering cone 30, which provides an improved means for maintaining the blade 26 and the drive shaft 24 in an operationally aligned and centered profile during actual reaming and chamfering of a cartridge case flash hole. The centering cone 30 is provided with a smooth tapered lower conical surface 46 which automatically accommodates to fit and center in cartridge case mouth openings of various diameters when the blade 26 is insertably engaged respectively within the cartridge case flash hole opening thereof. As can be seen in the sectional view of the centering cone 30 assembly as shown in FIG. 2, the cone is structurally comprised of a top 48 and a chamber 50 each being provided with an aligned drive shaft opening 52 respectively therethrough and assembled one to the other by cooperative cone assembly flanges 54 such that the top 48 thereof can reciprocally insert within the cone chamber 50 to the depth of a top stop 56 against compressive force of a coil spring 58 which holds the top 48 in a normally upward position as limited by the assembly flanges 54 as shown. Interior of the cone chamber 50, held in compressive contact with the lower cone chamber interior surface of the top 48 by the coil spring 58, is a cam lock disc 60 provided with an off-center opening 62 therein which functionally operates when rotated to cam-lock the centering cone assembly 30 to the hexagonally shaped drive shaft 24 at a chosen elevated position thereon for purposes of setting the improved uniformer 22 for accurately and consistently reaming and chamfering to uniform dimension and profile the flash hole openings of spent cartridge cases preparatory to the reloading thereof, all as will also hereinafter be more fully described on subsequent consideration of FIGS. 5 through 8.

As previously indicated, the pliable detachable handle 32 may be slidably removed to provide access to the chucking lug 34 so that the improved uniformer 22 can be insertably installed in the chuck of a power drive for mechanically operable rotation thereof.

The improved cartridge case flash hole uniformer 22 as shown and illustrated in FIG. 2, and certain subsequent Figures hereinafter, may be cast or machined and fabricated from various metals and alloys thereof, or plastics, or combinations of metals and metal alloys and plastics by methods and techniques commonly employed in such operations.

Referring now to FIGS. 3 and 4, which are respectively an exemplary spent cartridge case 64 first with a non-uniformed flash hole 66 and second with a uniformed flash hole 68 as accomplished with the improved uniformer 22 of instant invention. As shown in FIG. 3, the non-uniformed flash hole 66 is fouled with burnt powder residue 70 and is of a rough and non-uniform crossectional dimension, and the flash hole 66 cartridge case interior periphery which opens into the powder chamber 72 is rimmed and obstructed with metal burs 74 and other fouling and irregularities consequent from primer detonation and main propellant ignition during the cartridge firing process. If the spent cartridge case 64 is reloaded without a uniforming reaming and chamfering of the flash hole 66, and the flash hole 66 and case interior periphery thereof remains in a fouled and irregular condition as shown in FIG. 3, which would be a non-uniform irregular condition from case to case, then there is a consequent irregular and irratic communication of primer detonation flash bloom through and out of the flash hole 66 into the cartridge case powder chamber 72, with irratic main propellant ignition and pressure profile generation, and a resultant inconsistency in cartridge factor accuracy performance from round to round. However, if every spent cartridge case 64 in a particular lot for reloading has performed upon it in the preparation thereof a step to provide a uniformed flash hole 68 from case to case, as shown in FIG. 4, then the communication of primer detonation flash bloom through and out of the uniformed flash hole 68 is accomplished without irregular obstruction and is thus consistent from round to round and the cartridge factor accuracy variables otherwise resultant therefrom as related to main propellant ignition are reduced to a minimum.

Turning attention now to the series of side sectional elevation views shown in FIGS. 5 through 8, which illustrate operational use of the improved cartridge case flash hole uniformer 22 of present invention in accomplishing uniformed flash hole reaming and chamfering, and regardless of whether the uniformer 22 were being hand manipulated for manual operation thereof, or chucked in a rotary power drive means for mechanical operation, the procedure and process would be essentially the same. It is to be further understood that in operational use of the uniformer 22 one would be working on a segregated lot of spent cartridge cases comprised of all the same size and caliber.

Figures 5, 6, 7, 8:
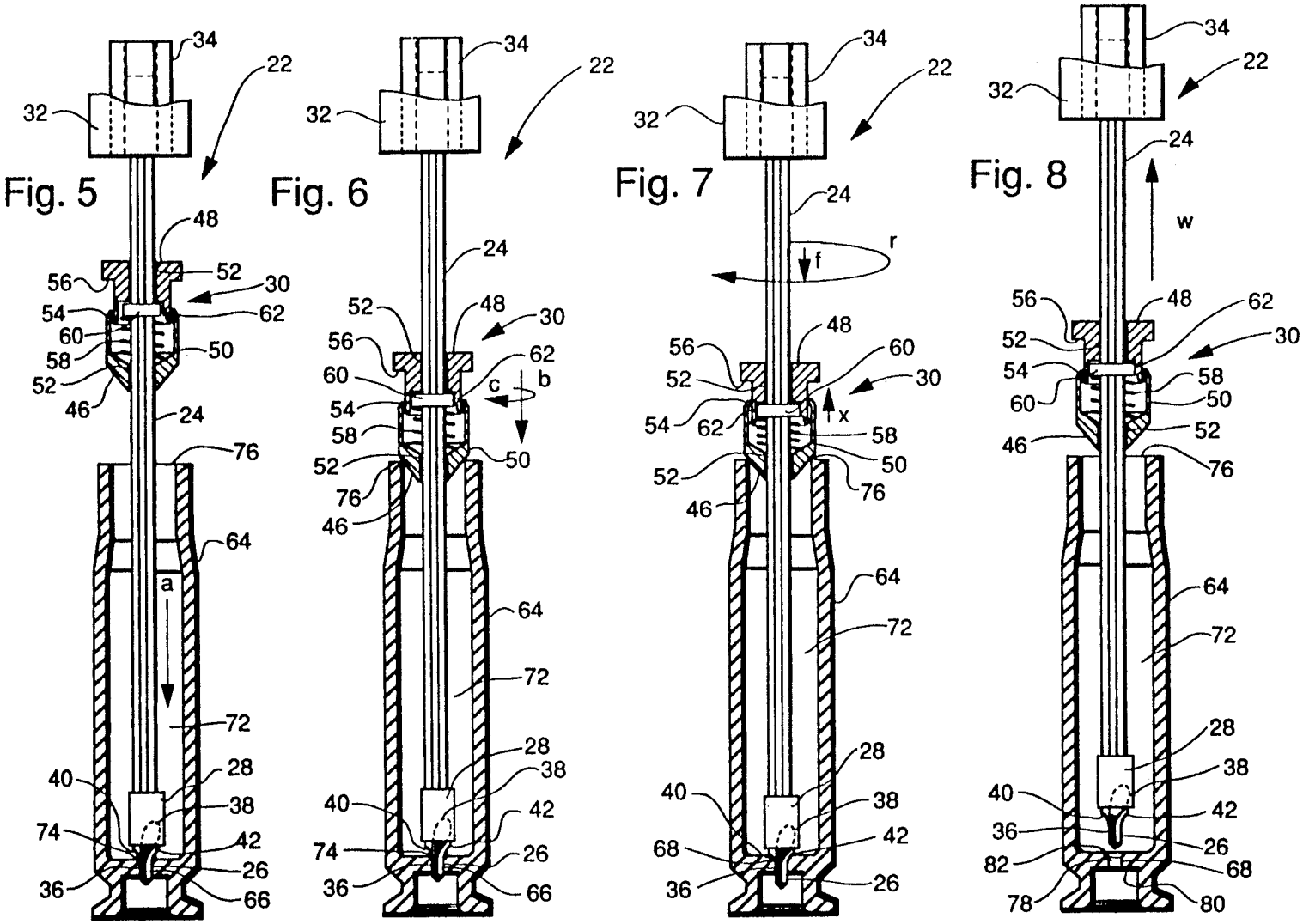
FIGS. 5 through 8 inclusive are a series of side sectional elevations progressively illustrating operational use of the improved cartridge case flash hole uniformer of present invention in accomplishing uniformed flash hole reaming and chamfering.

Initially, as shown in FIG. 5, the centering cone 30 is slidably withdrawn upon the drive shaft 24 towards the handle 32 end thereof, and the blade 26 end of the uniform 22 is inserted through the case neck mouth opening 76 of the spent cartridge case 64 and into the non-uniformed flash hole 66 as generally indicated by the uniformer insertion arrow "a".

Upon accomplishment of the foregoing the centering cone 30 is slidably advanced down the drive shaft 24 until the lower conical surface 46 thereof uniformly touches and engages in mutual circumferential contact the periphery of the case neck mouth opening 76 as shown in FIG. 6, being indicated by the centering cone positioning arrow "b", at which elevational setting the centering cone is then manually rotated as indicated by centering cone rotational arrow "c" so that the cam lock disc 60 rotationally operates within the off-center opening 62 to thereby effect lockable setting of said centering cone 30 for the particular case 64 size and caliber whereby with insertable positioning of the reaming and chamfering blade 26 within the non-uniformed flash hole 66 as shown, the drive shaft 24 is thereby positioned and operationally maintained in a direct aligned and centered disposition from the case neck mouth opening 76 to the non-uniformed flash hole opening during the flash hole reaming and chamfering uniforming operation. A more detailed description of the centering cone 30 cam lock disc 60 rotational locking mechanism and procedure will be set forth on consideration of FIG. 10 hereinafter. The centering cone 30 set procedure as above described, however, comprises the only make-ready step in preparation for use of the uniformer 22 in case by case flash hole reaming and chamfering operations on a particular lot of size and caliber segregated spent cartridge cases for uniforming.

The view shown in FIG. 7 illustrates operational use of said uniformer 22 in accomplishing the actual reaming and chamfering of a uniformed flash hole 68, in which regard a downward force is applied to the inserted uniformer 22 as shown by arrow "f" and the uniformer is simultaneously rotated either manually or mechancially as shown by the arrow "r" to thereby operate the self-cleaning reaming and chamfering blade 26 and effect flash hole uniforming. It will be noted that as the blade 26 insertably extends through the flash hole to the point of stoppage by the hardened blade shoulder 42, the coil spring 58 compresses within the cone chamber 50 as indicated by arrow "x" to compensate for the flash hole insertable blade movement and thereby operates at the same time to maintain the drive shaft 24 in a straight and aligned disposition during accomplishment of flash hole uniforming operations.

Upon completion of flash hole uniforming operations as above described the uniformer 22 is withdrawn, being indicated in FIG. 8 by arrow "w", and the above procedure, minus the centering cone setting steps is successively repeated on the balance spent cartridge cases 64 to be processed.

The profile of a uniformed flash hole 68 in a processed cartridge case is as shown in both FIGS. 4 and 8, which as illustrated respectively therein provides a smooth unobstructed flash conduit of smooth uniform cross-section communicating from the base of the primer pocket 80 to the chamfered flash hole mouth 82 opening into the cartridge case powder chamber 72, whereby a uniform full-blown primer flash bloom is communicated from the primer pocket 80 through the uniformed flash hole 68 into the powder chamber 72 for consistent ignition and detonation of the propellant charge so that cartridge factor accuracy attributable to propellant burning profiles and pressure generation in providing bullet driving force is highly consistent and uniformily repeatable from round to round.

Considering now the view shown in FIG. 9, which illustrates the uniformer 22 with the pliable detachable handle thereof removed to thereby expose the chucking lug 34 for insertion and retention within the chuck 84 of a power drive, such as that of a slow speed drill press or a cordless powered screwdriver handle, thus to impart mechanically driven rotary motion to said uniformer in accomplishing flash hole reaming and chamfering operations therewith.

The illustration shown in FIG. 10 is that of an enlarged top sectional view of the adjustably set and locakble spring loaded centering cone 30, and depicts that manner whereby the same is rotatably cam-locked at a set elevated position upon the drive shaft 24 by counter-rotating said drive shaft 24 and the cam lock disc 60 insertably assembled thereon in a direction opposite to that of the cone top 48 therein having the cam lock disc off-center opening 62, respectively in the directions as indicated by the arrow "ds" for the drive shaft 24 and arrow "ct" for the cone top 48, to thereby cam-lock the disc 60 in the off-center opening 62 as shown in phantom line rendition in FIG. 10. Unlocking of the centering cone 30 assembly is accomplished by a counter-rotational reverse of the above described procedure.

Although the improved cartridge case flash hole uniformer invention hereof, the structural components and method of employment thereof, respectively have been shown and described in what is conceived to be the most practical and preferred embodiment, it is reognized that departures may be made respectively therefrom within the scope of the invention, which is not to be limited per se to those specific details as disclosed herein but is to be accorded the full scope of the claims so as to embrace any and all equivalent such devices, apparatus, and methods.

I claim:

1. An improved cartridge case flash hole uniformer, said uniformer comprising in combination an elongated central support and drive shaft, a hardened self-cleaning reaming and chamfering tool fixedly assembled at one terminal end of said elongated central support and drive shaft and on axial alignment therewith, a pliable detachable handle slidably assembled over a chucking lug in turn assembled at the other terminal end of said elongated central support and drive shaft said pliable detachable handle and said chucking lug being respectively on axial alignment therewith, and an adjustably set and lockable spring loaded centering cone assembly slidably disposed in axial alignment upon said elongated central support and drive shaft intermediate said hardened self-cleaning reaming and chamfering tool and said chucking lug, said adjustably set and lockable spring loaded centering cone assembly being adjustably setable slidably and lockably fixed rotationally at a selected set position upon said elongated central support and drive shaft to dimensionally accommodate cartridge cases for use in achieving a uniform flash hole opening reaming and chamfering to a consistently dimensional profile from case to case in a caliber and size segragated lot of spent cartridge cases.

2. An improved cartridge case flash hole uniformer according to claim 1 wherein said elongated central support and drive shaft has a hexagonal cross-sectional shape.

3. An improved cartridge case flash hole uniformer according to claim 1 wherein said hardened self-cleaning reaming and chamfering tool is fixedly assembled at said one terminal end of said elongated central support and drive shaft and on axial alignment therewith by means of a retaining sleeve.

4. An improved cartridge case flash hole uniformer according to claim 1 wherein said hardened self-cleaning reaming and chamfering tool has a cutting mandrel shank for accomplishing uniformed flash hole reaming.

5. An improved cartridge case flash hole uniformer according to claim 4 wherein said cutting mandrel shank at the elongated central support and drive shaft assembly end thereof is provided with a hardened radiused enlargement for accomplishing uniformed flash hole case interior opening chamfering.

6. An improved cartridge case flash hole uniformer according to claim 5 wherein said cutting mandrel shank, above the hardened radiused enlargement thereon, is provided with a hardened shoulder to stoppably engag the cartridge case flash hole interior periphery opening and thereby consistently limit tool insertion into and through said flash hole and thus insure a consistent uniformed flash hole profile from case to case.

7. An improved cartridge case flash hole uniformer according to claim 1 wherein said adjustably set and lockable spring loaded centering cone assembly is provided with a cam lock disc that is counter rotationally operable within an off-center opening to lockably effect the adjustably set fixment of said centering cone assembly upon said elongated central support and drive shaft.

* * * * *